US012146271B2

(12) United States Patent
Schonstein

(10) Patent No.: US 12,146,271 B2
(45) Date of Patent: Nov. 19, 2024

(54) VEHICLE RAIL MOUNTING DEVICE

(71) Applicant: SPECTER INNOVATIONS GROUP PTY LTD., Rose Bay (AU)

(72) Inventor: Peter Schonstein, Rose Bay (AU)

(73) Assignee: SPECTER INNOVATIONS GROUP PTY LTD., Rose Bay (AU)

( * ) Notice: Subject to any disclaimer, the term of this patent is extended or adjusted under 35 U.S.C. 154(b) by 738 days.

(21) Appl. No.: 17/046,826

(22) PCT Filed: Apr. 11, 2019

(86) PCT No.: PCT/AU2019/050321
§ 371 (c)(1),
(2) Date: Oct. 12, 2020

(87) PCT Pub. No.: WO2019/195887
PCT Pub. Date: Oct. 17, 2019

(65) Prior Publication Data

US 2021/0148056 A1 May 20, 2021

(30) Foreign Application Priority Data

Apr. 11, 2018 (AU) ..... 2018901202

(51) Int. Cl.
*E01B 9/42* (2006.01)
*E01B 9/48* (2006.01)
*E01B 9/68* (2006.01)

(52) U.S. Cl.
CPC ..... *E01B 9/42* (2013.01); *E01B 9/483* (2013.01); *E01B 9/681* (2013.01); *E01B 2201/04* (2013.01)

(58) Field of Classification Search
CPC ..... E01B 9/00; E01B 9/38; E01B 9/40; E01B 9/42; E01B 9/44; E01B 9/46; E01B 9/48;
(Continued)

(56) References Cited

U.S. PATENT DOCUMENTS 3,858,804 A * 1/1975 Hixson ..... E01B 9/02 238/346
4,326,670 A * 4/1982 Sherrick ..... E01B 9/66 238/349

(Continued)

FOREIGN PATENT DOCUMENTS

DE 1292149 B 4/1969
EP 0546363 A1 6/1993

(Continued)

*Primary Examiner* — Zachary L Kuhfuss
*Assistant Examiner* — Cheng Lin
(74) *Attorney, Agent, or Firm* — Rivka Friedman

(57) ABSTRACT

A vehicle rail mounting device (10) Is provided for mounting a vehicle rail (12) on a support structure (14). The device Includes a bottom piece (16), an elastomeric bearing element (18) to be supported on the bottom piece, top cover elements (22) having elastomeric element retainers (54), a top piece (20), and rail connectors (82). The elastomeric element retainers are provided to retain the elastomeric element in place while the elastomeric element is adapted to retain the top piece, and hence the rail connectors, and therefore also the rail, in place. The top cover elements can be connected to the to the bottom and to the support structure to keep the whole device in place.

15 Claims, 4 Drawing Sheets

(58) Field of Classification Search
CPC ... E01B 9/483; E01B 9/54; E01B 9/68; E01B 9/681; E01B 9/685; E01B 9/686; E01B 9/688; E01B 2201/02; E01B 2201/04; E01B 2201/10
See application file for complete search history.

(56) References Cited

U.S. PATENT DOCUMENTS

| | | | | | |
|---|---|---|---|---|---|
| 4,561,589 | A * | 12/1985 | Hixson | E01B 9/66 | 238/297 |
| 4,728,031 | A * | 3/1988 | Heim | E01B 9/40 | 238/302 |
| 4,967,954 | A * | 11/1990 | von Lange | E01B 9/34 | 238/349 |
| 6,789,740 | B2 * | 9/2004 | Osler | E01B 9/54 | 238/283 |
| 9,657,445 | B2 * | 5/2017 | Awi Abalo | E01B 9/60 | |
| 2003/0084813 | A1 | 5/2003 | Osler | | |
| 2005/0045059 | A1 | 3/2005 | Osler | | |
| 2007/0001020 | A1 * | 1/2007 | Schonstein | E01B 9/34 | 238/306 |

FOREIGN PATENT DOCUMENTS

| | | | | |
|---|---|---|---|---|
| GB | 191315178 | A | 3/1914 | |
| WO | 2005083178 | A1 | 9/2005 | |
| WO | 2005108675 | A1 | 11/2005 | |
| WO | WO-2013091590 | A2 * | 6/2013 | E01B 9/38 |

* cited by examiner

VEHICLE RAIL MOUNTING DEVICE

FIELD OF THE INVENTION

The present invention relates to a vehicle rail mounting device for mounting a vehicle rail, such as a train rail, on a support structure, such as a ground surface.

BACKGROUND TO THE INVENTION

Rail mounting devices for mounting train rails or other vehicle rails on rail support structures are known. However, one of the problems with known mounting devices is that their elastomeric members are typically secured in place by adhesives or other bonding materials and this can have a negative effect on production costs.

Another disadvantage of certain known rail mounting devices is that their main components, other than elastomeric shock- and vibration-absorbing members, are typically of metal. The designs of such devices do not lend themselves to the devices being made of other materials such as plastics which may be preferable in terms of not suffering from rust and corrosion; being of lower weight; being easier, cheaper and quicker to manufacture; and so on.

A further disadvantage of known rail mounting devices is that they are susceptible to their lower areas being fouled by concrete that is poured below the devices, especially in "top down" construction methods in which the devices are supported or suspended over the concrete pouring areas. To prevent such fouling, and for achieving desired levelling of the mounting devices, shims or other elements of plastic, steel or other suitable materials, are often positioned first, with the mounting devices then placed upon them. This can add to time, cost and inconvenience in the process of installing the mounting devices.

It is an object of the present invention, at least in specific embodiments, to overcome or ameliorate one or more of the disadvantages of the prior art, or to provide a useful alternative thereto.

SUMMARY OF THE INVENTION

According to a first aspect of the invention there is provided a vehicle rail mounting device for mounting a vehicle rail on a rail support structure so that the vehicle rail extends in a rail longitudinal direction, the device including:

- a bottom piece adapted to be supported on the support structure;
- at least one elastomeric bearing element adapted to be supported on the bottom piece;
- at least one top cover element having at least one top cover connector adapted to enable releasable connection of the at least one top cover element to at least one of the bottom piece and the support structure so as to secure the at least one top cover element relative to the support structure and to the bottom piece,
- the or each of the at least one top cover element having at least one elastomeric element retainer which as adapted, when the at least one top cover element is releasably connected to at least one of the bottom piece and the support structure, to prevent removal of at least one retained elastomeric element of the at least one elastomeric element, from the bottom piece;
- a top piece; and
- at least one rail connector being an integral part of, or fixable to, the top piece,

- wherein the top piece is adapted for inter-engagement with the at least one retained elastomeric element such that, when the at least one retained elastomeric element is prevented by the at least one elastomeric element retainer from being removed relative to the bottom piece, the top piece is prevented by the at least one retained elastomeric element from being removed relative to the bottom piece.

In a preferred embodiment of the invention the or each top cover element includes first top cover element locking formations and the bottom piece includes first bottom piece locking formations, wherein

- the at least one top cover element, top plate, and at least one elastomeric element are adapted to be moveable in a direction transverse to the rail longitudinal direction, relative to the bottom piece, and
- the first top cover element locking formations are adapted to engage the first bottom piece locking formations to prevent said movement in said transverse direction.

In a preferred embodiment of the invention the or each top cover element includes at least one second top cover element locking formation and the bottom piece includes at least one second bottom piece locking formation complementary to the at least one second top cover element locking formation and which is engageable with the at least one second top cover element locking formation to prevent movement of the at least one top cover element, top plate, and at least one elastomeric element in the rail longitudinal direction, relative to the bottom piece.

In a preferred embodiment of the invention the at least one top cover connector enables the at least one top cover element to be releasably tightenable to the bottom piece and support structure;

- the vehicle rail mounting device is adapted to be moveable in a direction transverse to the rail longitudinal direction, relative to the support structure when the at least one top cover element is not tightened relative to the support structure and bottom piece; and
- the vehicle rail mounting device is adapted not to be moveable in a direction transverse to the rail longitudinal direction when the at least one top cover element is tightened relative to the support structure and bottom piece using the at least one top cover connector.

In a preferred embodiment of the invention the or each top piece connector includes a top piece connector hole, and the bottom piece includes at least one bottom piece connector hole, wherein the or each top piece connector hole and the or each bottom piece connector hole enable the at least one top cover element to be releasably connected to the bottom piece by at least one connector device that passes through the or each top piece connector hole and the or a respective aligned bottom piece connector hole.

Preferably, the or each connector device is a holding down device wherein the or each top piece connector hole and the or each aligned bottom piece connector hole enable the at least one top cover element to be releasably connected to the bottom piece and to the support structure by said at least one holding down device passing though the or each top piece connector hole and the or a respective aligned bottom piece connector hole, and into an or a respective aligned hole in said support structure.

Then, the or each holding down device preferably includes a bolt and preferably includes a washer.

In a preferred embodiment of the invention the vehicle rail mounting device includes first engagement formations fixed relative to the or each washer, and complementary engagement formations fixed relative to the or each top cover element, the engagement formations fixed in relation to the or each washer being adapted to engage corresponding engagement formations fixed in relation to the or a respective top cover element when the or the respective bolt is tightened relative to that top cover element to restrain that top cover element relative to that bolt.

In a preferred embodiment of the invention the vehicle rail mounting device includes a pair of rail connectors which are adapted to be fix to the top plate by inter-engagement of at least one part of each the of the rail connectors with at least one corresponding part of the top plate.

Preferably, the rail connectors of said pair of rail connectors are attached to each other by at least one joining element.

A vehicle rail mounting device according to any one claims 1 to 8 including a pair of rail connectors which are integrally joined to the top plate.

In a preferred embodiment of the invention the vehicle rail mounting device according includes at least one rail connector which includes a bolt and nut adapted to restrain a rail retainer element so that the rail retainer element secures the rail to the vehicle rail mounting device.

In another preferred embodiment of the invention the vehicle rail mounting device includes at least one rail connector which includes a T-bolt adapted to restrain a rail retainer element so that the rail retainer element secures the rail to the vehicle rail mounting device.

Preferably, the bottom piece includes a bottom piece lower portion and at least one restraint portion, the vehicle rail mounting device being adapted so that when in an operational orientation, the bottom piece lower portion is adapted to support, above it, the at least one elastomeric element, and the at least one restraint portion extends upwardly from the bottom piece lower portion, and includes at or adjacent to an upper extremity thereof, said first bottom piece locking formations; and the or each top cover element includes a flange extending in a direction away from the top piece, the or each flange including said first top cover element locking formations.

In a preferred embodiment of the invention at least one of the at least one elastomeric element includes at least one slanted wall, wherein, when the vehicle rail mounting device is in an operational orientation, the or each slanted wall extends upwardly, and has a direction of slant relative to the vertical away from the top piece.

Preferably the vehicle rail mounting device includes a space underneath the or each slanted wall, and a or a respective spacer located in the or each space, the or each spacer being adapted to support the or the respective slanted wall.

BRIEF DESCRIPTION OF THE DRAWINGS

Preferred embodiments of the invention will now be described, by way of example only, with reference to the accompanying drawings in which.

DETAILED DESCRIPTION

Figure 1:
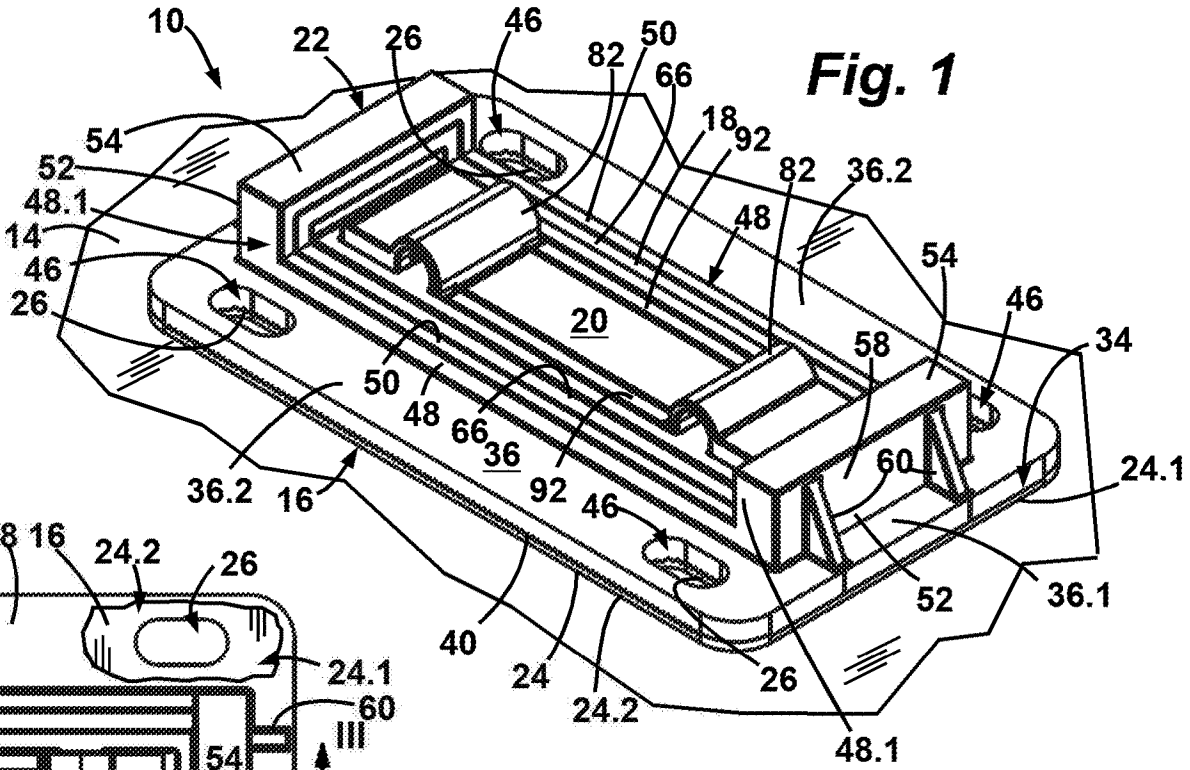
FIG. 1 is a perspective view of a vehicle rail mounting device according to an embodiment of the invention.

Referring to the drawings, there is shown a vehicle rail mounting device 10 for mounting a vehicle rail 12, such as a train rail, on a rail support structure 14. The device 10 includes a plastics bottom piece 16, an elastomeric element 18, a plastics top plate 20, and a plastics top cover element 22.

While the plastics bottom piece 16, plastics top plate 20, and plastics top cover element 22 are of plastics in this embodiment, in other embodiments (not shown) each of these may be of another suitable material such as metal.

Figure 3:
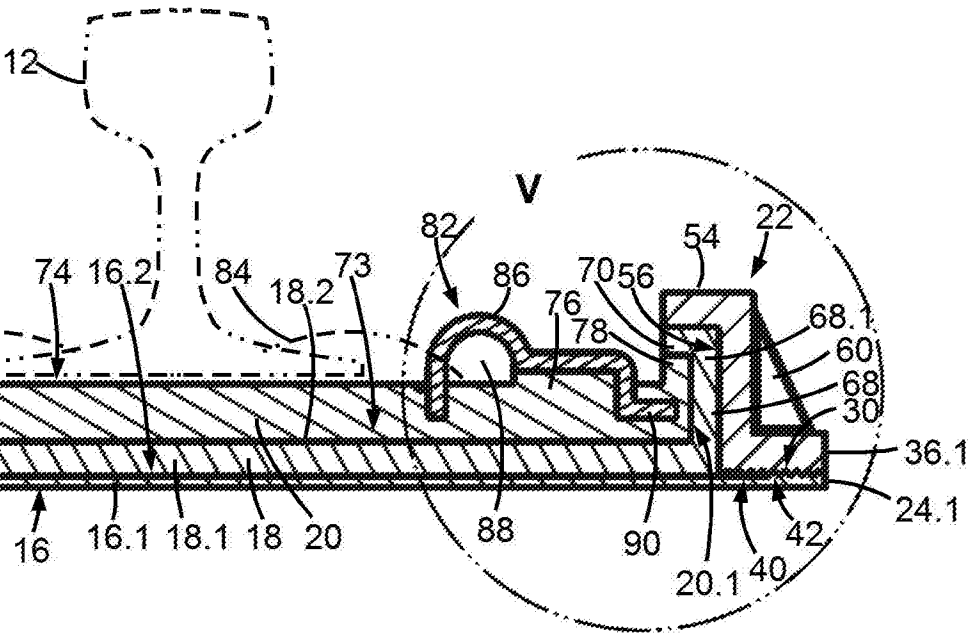
FIG. 3 is a section view along line III-III in FIG. 2.

The device 10 is adapted for mounting the rail 12 (as seen in FIG. 3) so that the rail extends in a direction perpendicular to the plane of the image of the device as shown in that figure—i.e. to the plane of the page on which the image is presented (regardless of whether that direction is considered to extend into or out of the plane of that image), in which the rail is shown in cross-section in dashed lines. Although the device 10 itself has a length extending from left to right (and vice versa) and a width extending perpendicular to the plane of the image in that figure, the direction in which the rail 12 extends, corresponding to the direction of the width of the device, is referred to herein as the rail longitudinal direction, while a direction transverse to that is referred to herein as the rail transverse direction.

The bottom piece 16 has a perimetral area 24 serving as a flange (and which is referred to below as such), having front and rear flanges portions 24.1 and side flanges portions 24.2.

Figure 2:
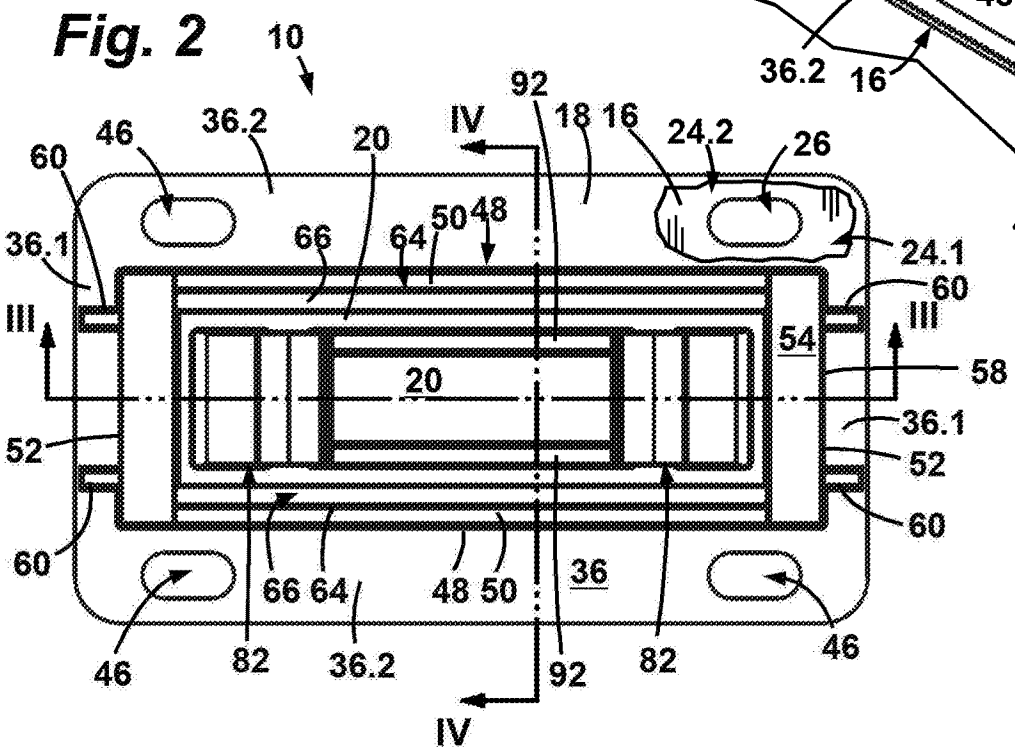
FIG. 2 is a plan view of the rail mounting device of FIG. 1, shown partly cut away.

Within the side flange portions 24.2 of the bottom piece 16, there are provided oblong bottom piece fixation holes 26 (see FIGS. 1 and 2).

The upper surfaces 28 of the end flange portions 24.1 and side flange portions 24.2 of the bottom piece 16 have longitudinal ridges 30 extending in the rail longitudinal direction, the longitudinal ridges in cross-section together defining a serrated formation.

The bottom piece 16 further has a central upper area 16.2, between the longitudinal ridges 30, which is flat.

The top cover element 22 has a perimetral flange 36 having end flange portions 36.1 and side flange portions 36.2 corresponding in extent, in the rail longitudinal and transverse directions, to the flange 24 of the bottom piece 16.

The lower surfaces 38 of the side flange portions 36.2 of the top cover element 22 have longitudinal ridges 40 extending in the rail longitudinal direction, the ridges in cross-section together defining a serrated formation, and being complementary to the longitudinal ridges 30 on the side flange portions 24.2 of the bottom piece 16. These longitudinal ridges 40 of the top cover element 22 are adapted to engage with the longitudinal ridges 30 of the bottom piece 16 as described further below.

Figure 4:
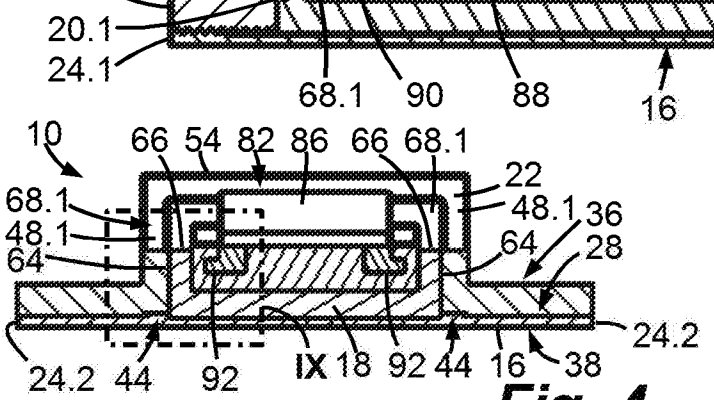
FIG. 4 is a section view along line IV-IV in FIG. 2.
Figure 9:
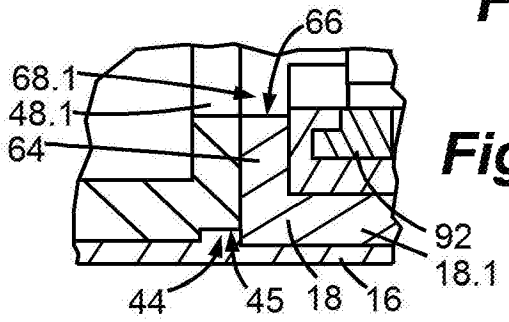
FIG. 9 is an enlarged view of the area identified as IX in FIG. 4.
Figure 7:
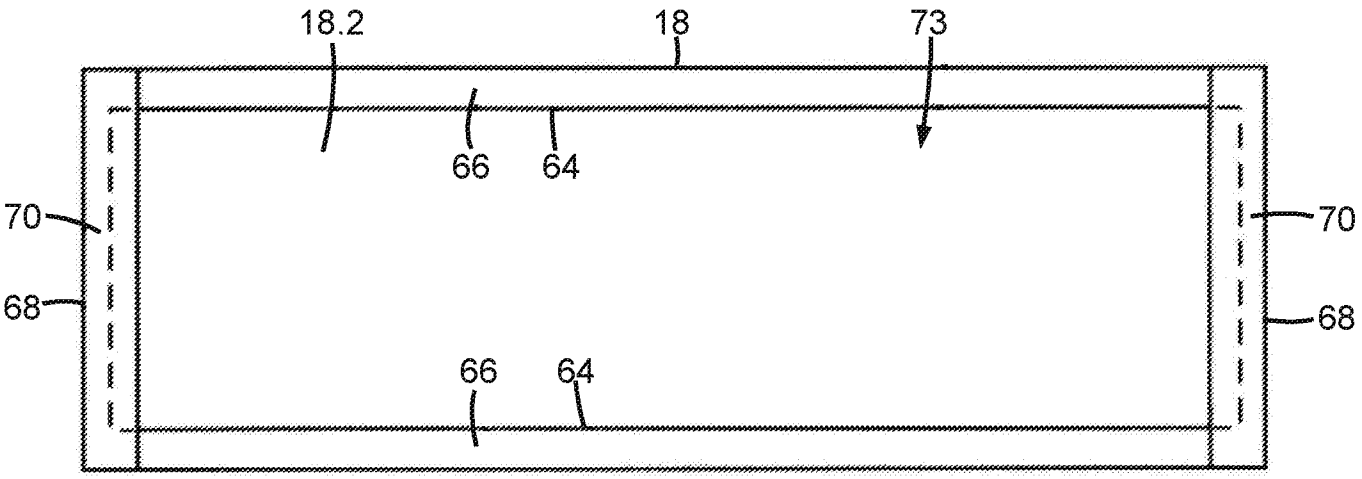
FIG. 7 is a schematic plan view of an elastomeric element of the device of FIG. 1.

As best see in FIGS. 4 and 9, the bottom piece 16 has raised elongate platforms 44 extending in the rail transverse direction and the top cover element 22 has complementary elongate recesses 45 which are adapted to receive the platforms 44.

Within the side flange portions 36.2 of the top cover element 22 there are provided oblong top cover element fixation holes 46. The top cover element fixation holes 46 are adapted to correspond in position and location to the bottom piece fixation holes 26 when the top cover element 22 is placed on the bottom piece 16 (as described below) such that the flange 36 of the top cover element is directly superimposed on the bottom piece flange 24.

Extending upwardly from the flange 36 of the top cover element 22 are top cover side walls 48 the major portion of which have upper edges 50 which extend most of the length of those side walls.

Also extending upwardly from the flange 36 of the top cover element 22, near the ends of the top cover element (in the rail transverse direction) are respective top cover end walls 52. As best seen in FIG. 1, the top cover end walls 52, together with adjacent portions 48.1 of the top cover side walls 48, extend higher than the upper edges 50 of the top cover side walls.

Extending across each of the top cover end walls 52 and corresponding adjacent portions 48.1 of the top cover side walls 48, is a respective cover portion 54.

Figure 5:
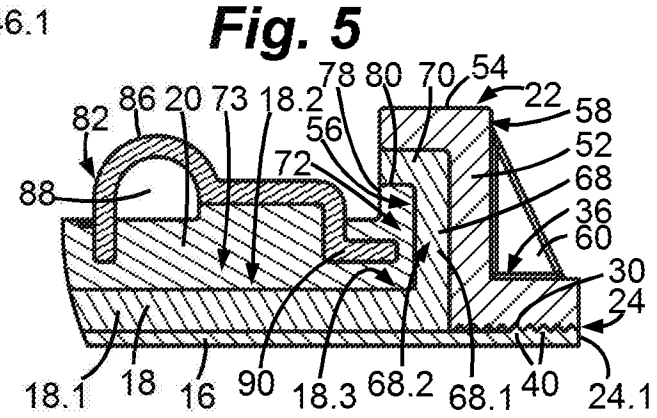
FIG. 5 is an enlarged view of the detail in FIG. 3 encircled by line V.

Each of the top cover end walls 52 together with the corresponding adjacent portions 48.1 of the top cover side walls 48 and corresponding cover portion 54 define a respective top cover end recess 56 (see especially FIGS. 3 and 5).

Defined by and between the top cover end walls 52 and top cover side walls 48 is a top cover lower opening (not shown).

Extending between, and joined to, outer surfaces 58 of the top cover end walls 52 and top cover element end flange portions 36.1, are reinforcement webs 60.

The elastomeric element 18 has a bottom portion 18.1 having an underside (not shown) with a shape which is partly complementary relative to the flat central upper area (not shown) of the bottom piece 16, so that the elastomeric element can be snugly and stably accommodated on that central area.

The upper surface 18.2 of the bottom portion 18.1 of the elastomeric element 18 is referred to below as the floor of the elastomeric element.

In addition, in a preferred embodiment (not shown) the underside of the elastomeric element 18 has further contouring to enhance the compressibility of the elastomeric element.

The elastomeric element 18 has upwardly extending side walls 64 (at the extremities of the element in the rail longitudinal direction), these side walls having side wall upper edges 66.

The elastomeric element 18 further has upwardly extending end walls 68 (at the extremities of the elastomeric element in the rail transverse direction). Each of these end walls 68 has a portion 68.1 extending above the side wall upper edges 66.

At the top of each of the elastomeric element end walls 68, there is a horizontally extending projection 70, which extends inwardly relative to the elastomeric element 18, that is, towards the other respective elastomeric element end wall (in the rail transverse direction).

As can best be seen in FIG. 5, at each of the ends of the elastomeric element 18 (in the rail transverse direction), the respective projection 70, a portion 18.3 of the elastomeric element floor 18.2 below that projection and a part 68.2 of the respective elastomeric element end wall 68 between the elastomeric element floor and the respective projection, together define a respective elastomeric element end recess 72.

The elastomeric element side walls 64 and end walls 68 together with the elastomeric element floor 18.2, together define an elastomeric element bottom recess 73. The surface of the elastomeric element floor 18.2 is substantially flat.

The top cover element 22 and elastomeric element 18 are complementary to each other in the sense that, if the elastomeric element is supported on the bottom piece 16 and the top cover element is suitably placed over the elastomeric element, the elastomeric element side walls 64 are snugly accommodated between the top cover side walls 48, while the elastomeric element end walls 68 and projections 70 at each end of the elastomeric element are snugly accommodated in the top cover end recesses 56, as best seen in FIGS. 1 and 3.

As best seen in FIG. 3, the top plate 20 has an upper surface central zone 74, and two platforms 76 slightly raised relative to the central zone. At each of the ends 20.1 of the top plate 20 is a top plate end wall 78 which extends upwardly relative to the central zone 74. Each of the top plate end walls 78 has an end wall upper surface 80 (see especially FIG. 5).

Each of the ends 20.1 of the top plate 20 including the respective top plate end walls 78, are complementary relative to the respective elastomeric element end recesses 72 so that those ends can be snugly accommodated within those recesses as best seen in FIGS. 1 and 3.

The top plate 20 as a whole is adapted to be snugly accommodated within the elastomeric element bottom recess 73, also as best seen in FIGS. 1 and 3.

When the top plate end walls 78 are accommodated within the elastomeric element end recesses 72, the projections 70 of the elastomeric element 18 are located immediately above, and preferably in slight contact with, the top plate end wall upper surfaces 80.

Rail fixation lugs 82 (see especially FIG. 3), are provided and are used for locating a rail 12 by means of securing elements collectively referenced 84, schematically represented by dashed lines in FIG. 3, which are adapted to secure the rail by spring action, clamping, bolting or other suitable action.

In the particular embodiment shown, each of the fixation lugs 82 has an arched portion 86 with a space 88 below it, and a locating portion 90 extending in a direction towards the respective closest end of the device 10 in the rail transverse direction.

The lugs 82 are connected to each other by metal side rails 92 (see FIGS. 4 and 9) which are integrally joined to, and thus form part of, the lugs. In other embodiments (not shown) the lugs 82 are not so interconnected.

As best seen in FIG. 4, each of the side rails 92 is L-shaped in cross-section, the lower portion of the "L" extending away from the other side rail, to facilitate location of the lugs 82. In other embodiments (not shown), other formations may be used to facilitate location of the lugs 82, such as ribs.

In the embodiment shown, in which the top piece 20 is of plastic material, the lugs 82 are preferably moulded into the plastic material when the top piece is formed. In other embodiments (not shown), they may be form-fitted into the top piece 20. Other suitable forms of attachment of the lugs 82 may be used, especially where the top piece 20 is of another material such as metal.

The side rails 92, by interconnecting the lugs 82, may assist in facilitating accurate positioning of the lugs relative to each other. They may also assist in distributing load between the lugs 82.

To assemble the device 10, the top plate 20 with the lugs 82 pre-installed on the top plate, can be engaged with the elastomeric element 18 by fitting the ends 20.1 of the top plate in the elastomeric element end recesses 72.

The elastomeric element 18, with the top plate 20 assembled to it, can then be positioned on the bottom piece 16. The top cover element 22 can then be placed over the elastomeric element 18 as described above, so that the flange 36 of the top cover element 22 is aligned with the bottom piece flange 24, and so that the top cover element fixation holes 46 are aligned with the bottom piece fixation holes 26.

In this relative position of the top cover element 22 and bottom piece 16, the top cover element longitudinal ridges 40 will be engaged with the complementarily positioned and orientated longitudinal bottom piece ridges 30.

Figure 6:
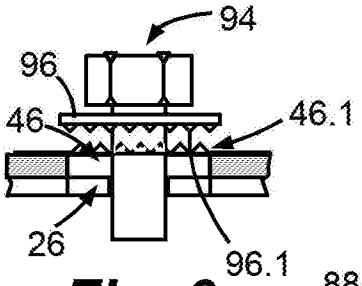
FIG. 6 is a schematic front view, shown partly in section, of a feature of the mounting device of FIG. 1 with a holding down device.

The device 10 can be secured to a rail support structure 14 by means of suitable bolts, studs or similar affixing means, generally referred to as holding down devices and referenced 94 as shown in FIG. 6. In addition, the securing involves the use of washers 96, also as shown in FIG. 6.

The holding down devices 94 can be positioned to extend through the aligned fixation holes 46, 26 of the top cover element 22 and bottom piece 16 and into suitable holes (not shown) in the support structure 14.

Adjacent to each of the fixation holes 46 are slide limiting formations 46.1 (see FIG. 6) on the top cover element 22 (which in the present embodiment are in the form of serrations) which are adapted to engage with complementary slide limiting formations 96.1 on the lower side of the washer 96.

Engagement of the slide limiting formations 96.1 of the washers 96 with the slide limiting formations 46.1 on the top cover element 22 can facilitate grip between the holding down devices 94 and the top cover element when the holding down devices are tightened in relation to the top cover element. This can assist in preventing sliding of the top cover element 22 in the rail transverse direction relative to the holding down devices 94. In order to assist in freeing the top cover element 22, and thus the device 10 as a whole relative to the support structure 14, it is necessary to separate the slide limiting formations 46.1 on the top cover element 22 from the slide limiting formations 96.1 on the lower side of the washer 96, but untightening the holding down devices 94.

According to one embodiment, the underside 16.1 of the bottom piece is flat and non-profiled. Such a bottom piece 16 may be useful, for example, for the device 10 to be retrofit to a support structure 14 having a flat surface. In such a case, the flat underside 16.1 of the bottom piece 16 can facilitate adjustment of the position of the bottom piece, and hence the device 10 as a whole, relative to the support structure 14 as discussed below. The device 10 can be held in position on the support structure 14 by frictional engagement between the bottom piece 16 and support structure. Such frictional engagement will be facilitated by the tightening of the device 10 to the support structure 16 by holding down devices 94.

The elongate shape of each of the fixation holes 26, 46 provides for an amount of play between the respective holding down devices 94 and the respective fixation holes. This allows the whole device 10 and hence the rail 12 which is attached to and supported on the device, to be moved relative to the support structure 14 in the rail transverse direction. This can be achieved before the holding down devices 94 are tightened in place, or after loosening them.

Figure 8:
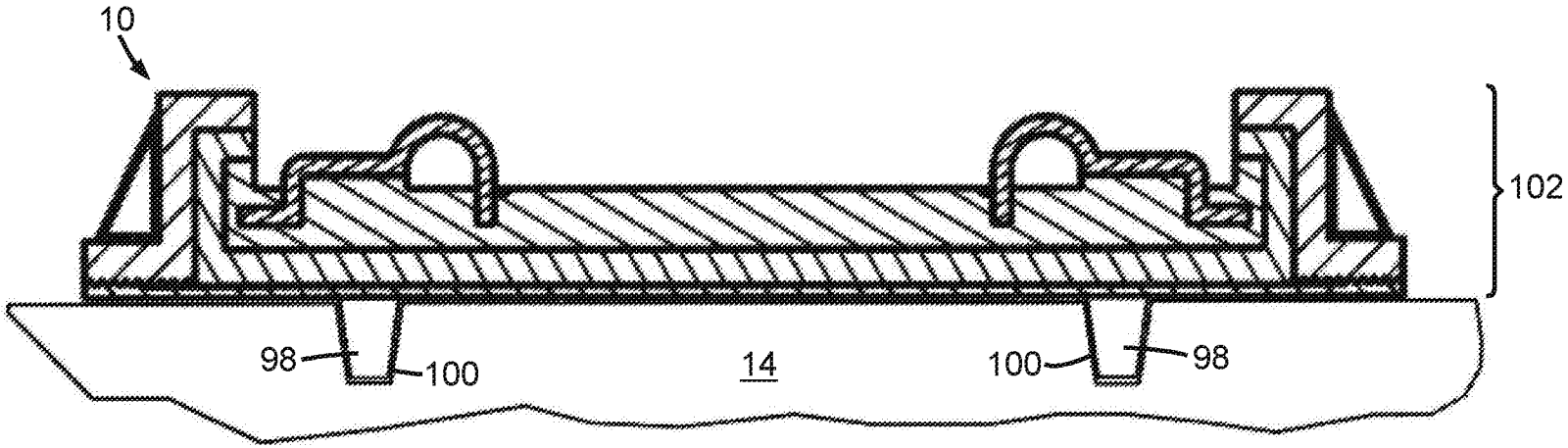
FIG. 8 is a section view corresponding with that of FIG. 3, but showing keying formations on an underside of the device and in the support structure on which the device is supported.

According to another embodiment (see FIG. 8), the underside 16.1 of the bottom piece 16 has a profile with formations 98 to serve to key the bottom piece in relation to complementary formations 100 in or on the support structure 14. In such a case, movement of at least the bottom piece 16 is restricted or prevented by inter-engagement of such keying formations 98, 100, together with frictional engagement between the bottom piece and support structure 14.

As the holding down devices 94 tighten the device 10 to the support structure 14, this will urge the top cover element 22 towards the support structure thus also tightening in place the bottom piece 16 which is sandwiched between the top cover element and support structure.

In the case where the bottom piece 16 is fixed or constrained relative to the support structure 14 by the keying formations 98, 100, the elongate shape of the fixation holes 26, 46 enables the top cover element 22, and hence all of the remaining components assembled to the top cover element 22 other than the bottom piece 16 (collectively referred to below as the top cover assembly 102), to be moved relative to the bottom piece 16, and hence relative to the support structure 14, in the rail transverse direction.

This may also be the case in an embodiment where there are no keying formations 98. 100, but where the bottom piece 16 is fixed or constrained relative to the support structure 14 by some other means. An example of such other means is where the bottom piece 16 is embedded or partially embedded, either intentionally or inadvertently, in cast concrete forming the support structure 14 or part thereof. This may occur, for example, during construction by the so-called Top Down Method (TDM) of construction.

To achieve such relative movement, it is necessary to separate the longitudinal ridges 30, 40 from each other, either after loosening the holding down devices 94, or before these devices are tightened. In particular, when the top cover element 22 and bottom piece 16 are not tightened to each other by holding down devices 94, the top cover assembly 102 can be separated from the bottom piece so that the longitudinal ridges 30, 40 of the bottom piece and top cover element are separated from each other. This allows the top cover assembly 102 to be moved relative to the bottom piece, and hence relative to the support structure 14, in the rail transverse direction.

On the other hand, when the top cover element 22 is tightened to the support structure 14 by holding down devices 94 extending through the fixation holes 26, 46, the longitudinal ridges 30 of the bottom piece 16 and longitudinal ridges 40 of the top cover element 22 are inter-engaged to facilitate prevention of relative movement between the top cover element, and hence the top cover assembly 102, and the bottom piece, in the rail transverse direction.

The secure connection of the bottom piece 16 to the support structure 14 due to frictional engagement as a result of the tightening of the holding down devices 94 (and the action of the keying formations 98, 100 where these are provided) thus assists in preventing movement of the assembly 102 relative to the support structure.

The accommodation of the raised platforms 44 of the bottom piece 16 in the recesses 45 of the top cover element 22 (see FIGS. 4 and 9) prevents relative movement between the top cover element and bottom piece in the rail longitudinal direction.

The device 10 can be pre-assembled and held together by the use of bolts, retainer clips and so on, generally referred to as fixation devices (not shown), or even by the holding down devices 94 which attach the top cover element 22 to the bottom piece 16. This can allow the device 10 to be assembled at a location remote from where it is to be installed. Once it is transported to the desired location, the device 10 can be secured to the support surface 14 using holding down devices 94 as described above, and the fixation devices, if used, can be removed if required.

When the vehicle rail mounting device 10 is used, as a rail vehicle travels along the rail 12, loads applied by the vehicle due to its weight and movement can be at least partly absorbed or accommodated by the elastomeric element 18, to reduce the load transmitted to the bottom piece 16 and hence to the support structure 14.

Downward loads might be at least partly absorbed by the bottom portion 18.1 of the elastomeric element 18. Loads in the rail transverse direction might be at least partly absorbed by the end walls 68 of the elastomeric element 18. Such transverse loads might also exert some rotational forces on the device 10 via the rail 12, and such rotational forces might be at least partly absorbed by the bottom portion horizontally extending projections 70 of the elastomeric element 18.

Figure 10:
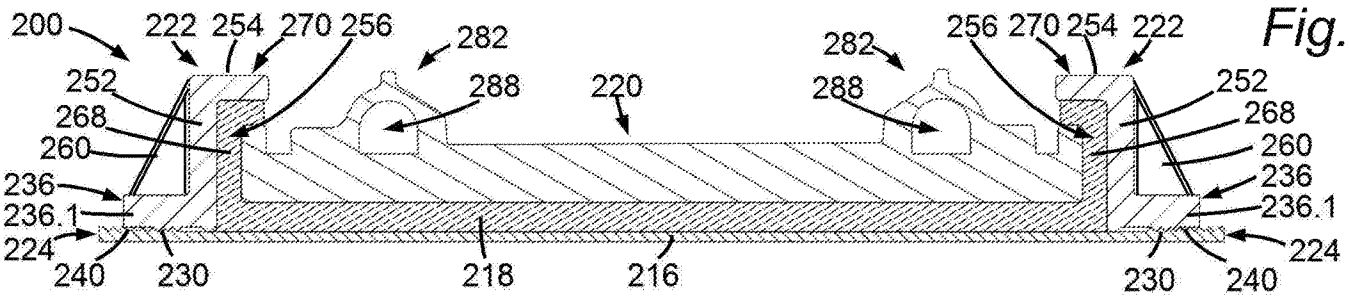
FIG. 10 is a view of a vehicle rail mounting device corresponding with the view of FIG. 3, but according to another embodiment of the invention.

Referring to FIG. 10, there is shown a rail mounting device 200 according to a different embodiment to that of the device 10. Features in FIG. 10 corresponding to features in any of FIGS. 1 to 9 have the same reference numbers as in those figures, except for being preceded by the number 2. Thus, for example, by way of explanation, the feature referenced 216 in FIG. 10 corresponds to the feature referenced 16 in any of FIGS. 1 to 9. The rail mounting device 200 differs from the device 10 in relation to the following features.

In the embodiment of FIG. 10, the top plate 220 and the fixation lugs 282 are integrally joined to each other, and are preferably of metal. The top plate 220 may alternatively be of another material such as plastic, but in this case, portions (not identified) of the lugs 282 may be of metal.

Figure 11:
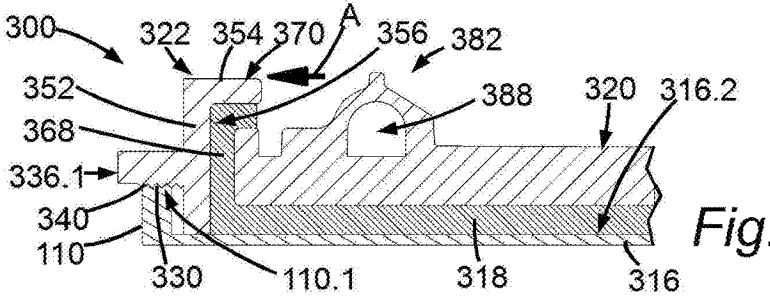

Referring to FIG. 11, there is shown a rail mounting device 300 according to a different embodiment to that of the device 10. Features in FIG. 11 corresponding to features in any of FIGS. 1 to 9 have the same reference numbers as in those figures, except for being preceded by the number 3. Thus, for example, by way of explanation, the feature referenced 316 in FIG. 11 corresponds to the feature referenced 16 in any of FIGS. 1 to 9. The rail mounting device 300 differs from the device 10 in relation to the following features.

The bottom piece 316 has end portions 110 at each of the ends of the device 300 in the rail transverse direction, which portions extend upwardly from the upper area 316.2 of the bottom piece 316. The longitudinal ridges 330 are located at the upper edges 110.1 of the end portions 110.

The end flange portions 336.1 of the top cover element 322 are not located adjacent the upper extremity of the top cover element as shown in the embodiment of FIGS. 1 to 9, but are raised relative to that upper extremity, so as to be located above upper edges 110.1 of the end portions 110.

The longitudinal ridges 340 are at the undersides of the flange portions 336.1 so as to be engaged with the longitudinal ridges 330 at the upper edges 110.1 of the end portions 110.

If outward forces in the rail transverse direction are applied to the top cover end walls 352, for example by a rail vehicle moving along a rail located on the device 300 (the vehicle and rail not being shown in FIG. 11), as indicated by the arrow A, the raised positions of the inter-engaging longitudinal ridges 330, 340 on the end portions 110 and flange portions 336.1, because of the leverage provided by such raised positioning, assists in providing resistance to such forces that urge the end walls 352 to rotate outwardly.

This may avoid or reduce the need for reinforcement webs, like the webs 60 of the embodiment of FIG. 1, to reinforce the top cover end walls 352.

In a preferred embodiment such webs (not shown) are provided to interconnect the flange portions 336.1 and end portions 110, in a similar manner to the webs 60 of the embodiment of FIGS. 1 to 9, for example at or near the corners of the device 300.

Figure 12:
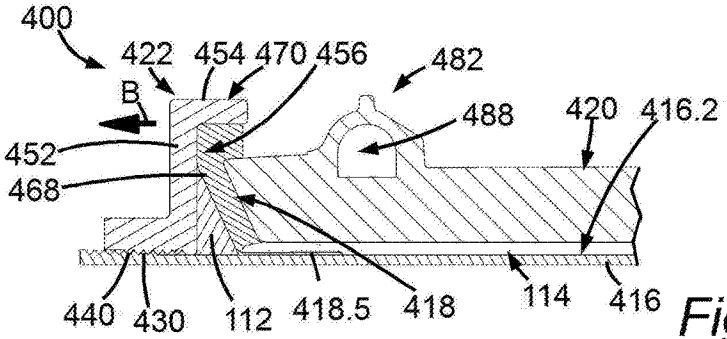
FIGS. 11 and 12 are views of vehicle rail mounting devices, the views corresponding to the view of FIG. 3, but according to yet other embodiments of the invention, with only the left hand side of each embodiment being shown, wherein the right hand side of each embodiment is a mirror image of the respective left hand side.

Referring to FIG. 12, there is shown a rail mounting device 400 according to a different embodiment to that of the device 10. Features in FIG. 12 corresponding to features in any of FIGS. 1 to 9 have the same reference numbers as in those figures, except for being preceded by the number 4. Thus, for example, by way of explanation, the feature referenced 416 in FIG. 12 corresponds to the feature referenced 16 in any of FIGS. 1 to 9. The rail mounting device 400 differs from the device 10 in relation to the following features.

The end walls 468 of the elastomeric element 418 extend upwards but not vertically as in the embodiment of FIGS. 1 to 9. Rather, they slant in a direction from the vertical, as indicated by the arrow B, away from the top piece 420, in the rail transverse direction as exemplified in FIG. 12.

Wedge-shaped spacers 112, preferably of plastics, are located in the spaces created beneath the end walls 468 due to their tilting orientations.

In a preferred embodiment, the side walls (not shown) of the elastomeric element 418 (i.e. those walls corresponding to the walls 64 of the embodiment of FIGS. 1 to 9) also slant in this manner. Indeed, in a preferred embodiment, the walls of the elastomeric element 418 that slant in this manner extend around the full periphery of the elastomeric element 418.

In yet another embodiment (not shown), only those side walls and not the end walls 468, slant in this manner.

Spacers 112 are provided in the gaps underneath each of the slanting walls, or the whole of the slanting wall where it is in the form of a single wall extending around the full periphery of the elastomeric element 418.

In this embodiment, the elastomeric element 418 does not fill the space between the bottom piece 416 and the top plate 420 as is the case in the embodiment of FIGS. 1 to 9. Rather, the elastomeric element 418 has, at each of its ends in the rail transverse direction, a thin portion 418.5 extending along the top of the bottom piece 416. There is a gap 114 above the thin portions 418.5.

In another embodiment (not shown), each thin portion 418.5 is separate from the remainder of the elastomeric element 418.

The end walls 468 of the elastomeric element 418 are provided for taking up the loads exerted by a rail vehicle travelling on a rail supported by the rail mounting device 400 during normal operating conditions (the vehicle and rail not being shown in FIG. 12), with a large portion of such loads being experienced as shear forces by the end walls due to their tilting orientations.

The thin portions 418.5 are for serving a secondary or overload function, that is, for taking up greater loads, that cannot be accommodated by the end walls 468. This will be when the amount of load on the device 400 is sufficient to cause an extent of deformation of the end walls 468 that will cause the top plate 420 to move through the gap 114 and come into contact with the thin portions 418.5. The thin portions 418.5 can thus assist in preventing the top plate 420 from coming into contact with the bottom piece 416.

Such overload situations may occur, for example, when the particular device 400 is designed for use with one type of rail traffic (say, passenger traffic) and is used for another type of rail traffic (say, freight traffic). Such overload situations may also occur, for example, when there are rail, or rail vehicle wheel, defects which result in impact loads on the device 400.

While the thin portions 418.5 extending from the end walls 468 near the ends of the elastomeric element 418 in the rail transverse direction are separate from each other and do not meet, in another embodiment (not shown) they extend sufficiently so as to form a continuous portion of the elastomeric element.

The spacers 112 provide support to the end walls 468.

Figure 13:
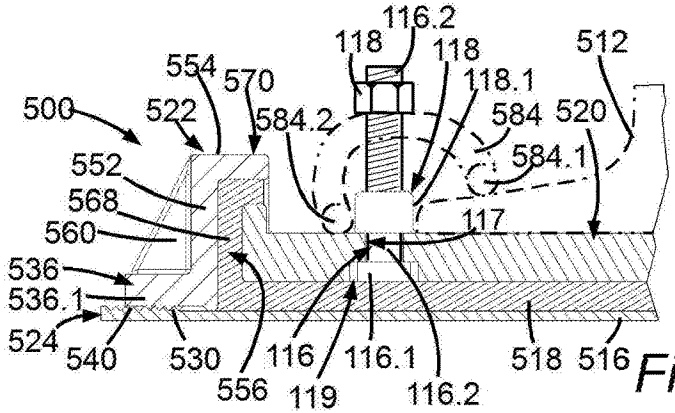

Referring to FIG. 13, there is shown a rail mounting device 500 according to a different embodiment to the device 10. Features in FIG. 13 corresponding to features in any of FIGS. 1 to 9 have the same reference numbers as in those figures, except for being preceded by the number 5. Thus, for example, by way of explanation, the feature referenced 516 in FIG. 13 corresponds to the feature referenced 16 in any of FIGS. 1 to 9. The rail mounting device 500 differs from the device 10 in relation to the following features.

In the rail mounting device 500, rail fixation lugs such as the 82 of the embodiment of FIGS. 1 to 9 are omitted. In order to secure the rail 512 to the device 500, there are provided T-bolts 116 having heads 116.1, and threaded shanks 116.2 extending through bolt passages 117 in the top piece 520. Also provided are nuts 118 for attachment to the bolts 118. The heads 116.1 of the bolts 116 are accommodated in recesses 119 at the bottom of the top piece 520.

Also provided is a shoulder element 120 through which the shank 116.2 extends. The shoulder element 120 includes a shoulder 120.1 against which the base of the rail 512 can abut.

Securing elements 584 are provided for holding down the rail 512. The nuts 118 can be tightened on the bolts 118, so as to also tighten the securing elements 584 in place. In the embodiment shown in FIG. 13, each securing element 584 is elongate, having one end 584.1 located on the base of the rail 512, and the other end 584.2 located on the opposite side of the respective bolt 118 on the top surface of the top plate 520, and which may abut the respective shoulder element 120.

The non-round shape of the heads 116.1 of the T-bolts 116 can prevent these bolts from rotating within the passages 117 as the nuts 118 are tightened relative to the bolts.

Figure 14:
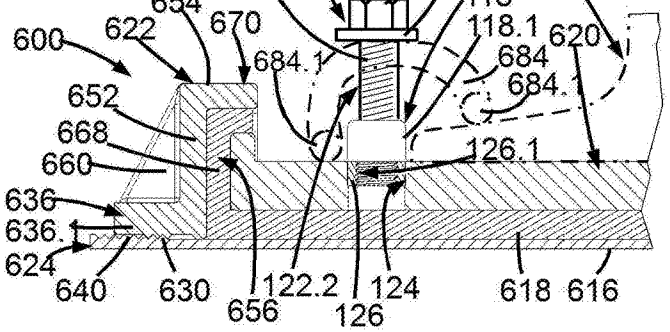
FIGS. 13 and 14 are views of vehicle rail mounting devices, the views corresponding with the view of FIG. 3, but according to yet other embodiments of the invention, with only the left hand side of each embodiment being shown, wherein the right hand side of each embodiment is a mirror image of the respective left hand side, each of these figures showing respective components for attachment of a vehicle rail.

Referring to FIG. 14, there is shown a rail mounting device 600 according to a different embodiment to the device 10. Features in FIG. 14 corresponding to features in any of FIGS. 1 to 9 have the same reference numbers as in those figures, except for being preceded by the number 6. Thus, for example, by way of explanation, the feature referenced 616 in FIG. 14 corresponds to the feature referenced 16 in any of FIGS. 1 to 9.

The rail mounting device 600 is the same as the rail mounting device 500 of FIG. 13, except that, instead of the T-bolts 116 and associated features, the device 600 is provided with the following features.

In order to secure the rail 612 to the device 600, there are provided bolts 122 having heads 122.1, and threaded shanks 122.2. Also part of each bolt 122, and integrally joined to the bottom of each of the bolt heads 122.1, is a bolt head washer 122.3 having a diameter extending beyond the lateral extremities of the head.

Bolt passages 124 are provided in the top plate 620, and in each of these passages there is an internally threaded metal insert 126.

Threads 122.3 of the bolts 122 are complementary to inner threads 126.1 of the insert 126. Each of the bolts 122 extends through a respective one of the inserts 126 and is secured to the insert by means of inter-engagement of the threads 122.3, 126.1.

As in the case of the device 500 of FIG. 13, there are also provided shoulder elements 128 through which the shanks 122.2 extend. Each shoulder element 128 includes a shoulder 128.1 against which the base of the rail 812 can abut.

The bolts 122 can be tightened relative to the inserts 126 by rotating-engagement of their threads 122.3, 126.1, so that the bolt head washers 122.4 bear against, and tighten in place, the securing elements 684.

In the embodiment shown in FIG. 14, each securing element 684 is elongate, having one end 684.1 located on the base of the rail 612, and the other end 684.2 located on the opposite side of the respective bolt 122 on the top surface of the top plate 620, and which may abut the respective shoulder element 128.

In different forms of the embodiment of FIG. 14, the inserts 126 are secured in place in different ways. According to one example the inserts 126 are externally threaded, with these external threads engaging with complementary internal threads on the inner walls of the passages 124 (these threads not being shown). In this case, the inserts 126 may be provided with laterally extending flanges (not shown) at their lower ends to engage with the top plate 620 near or at its bottom, to prevent the inserts from being pulled up relative to the top plate 620 as the bolts 122 are tightened relative to the inserts 126.

In this case, the top plate 620 may be provided with recesses (not shown) to accommodate the flanges, and the location of such recesses can depend on the manner of attaching the inserts 126 to the top plate 620.

For example, one manner of attaching the inserts 126 to the top plate 620 is by inserting the inserts into the passages 124 from the underside of the top plate. In this case, the recesses may open out through the bottom surface of the top plate 620, with the holes 124 opening into the tops of the recesses.

Another manner of attaching the inserts 126 to the top plate 620 is by insert moulding, with the inserts being positioned relative to the top plate when the top plate is moulded. In this case, the recesses in the top plate 620 for accommodating the flanges can be positioned between the upper and lower surfaces of the top plate.

As an alternative to the inserts 126 having the external threads as described above, the threads may be omitted but with the flanges and recesses still being provided.

The flanges may be of a non-round shape, for example rectangular or hexagonal, to prevent these, and hence the inserts 126 as a whole, from rotating within the passages 124 as the bolts 122 are tightened relative to the inserts 126. Alternatively, the inserts 126 may be provided with other means to prevent their rotation in this manner, such as webs (not shown) extending from the flanges, for example upwardly from the upper surfaces of the flanges to the sides of the inserts above the flanges.

Although the invention is described with reference to specific embodiments above, it is not limited to those embodiments but may be embodied in other forms falling within the scope of the claims.

For example, while in the embodiments described above in relation to FIGS. 1 to 9 there are four fixation holes 26, 46 in each of the bottom piece 16 and top cover element 22, in other embodiments (not shown), there may be different numbers of such holes, for example, two or three in each of those components.

In addition, while the elastomeric element in each of the above embodiments is of one unitary piece, in other embodiments, the elastomeric element may be in the form of a number of elastomeric element portions separated from one another. In this case the top piece may be provided with formations for at least partially defining spaces for keeping the elastomeric element portions in position relative to one another.

The invention claimed is:

1. A vehicle rail mounting device for mounting a vehicle rail on a rail support structure so that the vehicle rail extends in a rail longitudinal direction, the device including:

a bottom piece adapted to be supported on the support structure;

at least one elastomeric bearing element adapted to be supported over the bottom piece and defining at least one elastomeric element end recess;

at least one top cover element having at least one top cover connector adapted to enable releasable connection of the at least one top cover element to at least one of the bottom piece and the support structure so as to secure the at least one top cover element relative to the support structure and to the bottom piece, the or each of the at least one top cover element having at least one elastomeric element retainer which as adapted, when the at least one top cover element is releasably connected to at least one of the bottom piece and the support structure, to prevent removal of at least one retained elastomeric element of the at least one elastomeric element, from the bottom piece;

a top piece having top piece ends; and at least one rail connector being an integral part of, or fixable to, the top piece, wherein the top piece is inter-engaged with the at least one retained elastomeric element wherein the top piece is restrained by the at least one elastomeric element by means only of the top piece ends being held captive in the at least one elastomeric element end recess such that, when the at least one retained elastomeric element is prevented by the at least one elastomeric element retainer from being removed relative to the bottom piece, the top piece is prevented by the at least one retained elastomeric element from being removed relative to the bottom piece; and the or each top cover element includes first top cover element locking formations and the bottom piece includes first bottom piece locking formations, wherein the at least one top cover element, top piece, and the at least one elastomeric element together form at least part of a top cover assembly which is adapted to be moveable relative to the bottom piece between a first relative position in which the top cover element locking formations are separated from the bottom piece locking formations, and a second relative position in which the top cover element locking formations are engaged with the bottom piece locking formations, wherein, when the top cover assembly is in the first relative position, the top cover assembly is adapted to be moveable in a direction transverse to the rail longitudinal direction, relative to the bottom piece, and when the top cover assembly is in the second relative position, the first top cover element locking formations are adapted to prevent said movement in said transverse direction by said engagement with the bottom piece locking formations.

2. The vehicle rail mounting device of claim 1, wherein the or each top cover element includes at least one second top cover element locking formation and the bottom piece includes at least one second bottom piece locking formation complementary to the at least one second top cover element locking formation and which is engageable with the at least one second top cover element locking formation to prevent movement of the at least one top cover element, top plate, and at least one elastomeric element in the rail longitudinal direction, relative to the bottom piece.

3. The vehicle rail mounting device of claim 1, wherein the at least one top cover connector enables the at least one top cover element to be releasably tightenable to the bottom piece and support structure;

the vehicle rail mounting device is adapted to be moveable in a direction transverse to the rail longitudinal direction, relative to the support structure when the at least one top cover element is not tightened relative to the support structure and bottom piece; and the vehicle rail mounting device is adapted not to be moveable in a direction transverse to the rail longitudinal direction when the at least one top cover element is tightened relative to the support structure and bottom piece using the at least one top cover connector.

4. The vehicle rail mounting device of claim 1, wherein the or each top piece connector includes a top piece connector hole, and the bottom piece includes at least one bottom piece connector hole, wherein the or each top piece connector hole and the or each bottom piece connector hole enable the at least one top cover element to be releasably connected to the bottom piece by at least one connector device that passes through the or each top piece connector hole and the or a respective aligned bottom piece connector hole.

5. The vehicle rail mounting device of claim 4, wherein the or each connector device is a holding down device wherein the or each top piece connector hole and the or each aligned bottom piece connector hole enable the at least one top cover element to be releasably connected to the bottom piece and to the support structure by said at least one holding down device passing though the or each top piece connector hole and the or a respective aligned bottom piece connector hole, and into an or a respective aligned hole in said support structure.

6. The vehicle rail mounting device of claim 5, wherein the or each holding down device includes a bolt and washer.

7. The vehicle rail mounting device of claim 6, including first engagement formations fixed relative to the or each washer, and complementary engagement formations fixed relative to the or each top cover element, the engagement formations fixed in relation to the or each washer being adapted to engage corresponding engagement formations fixed in relation to the or a respective top cover element when the or the respective bolt is tightened relative to that top cover element to restrain that top cover element relative to that bolt.

8. The vehicle rail mounting device of claim 1, wherein the at least one rail connector includes a pair of rail connectors which are adapted to be fixed to the top plate by inter-engagement of at least one part of each of the rail connectors with at least one corresponding part of the top plate.

9. The vehicle rail mounting device of claim 8, wherein the rail connectors of said pair of rail connectors are attached to each other by at least one joining element.

10. The vehicle rail mounting device of claim 1, including a pair of rail connectors which are integrally joined to the top plate.

11. The vehicle rail mounting device of claim 1, including at least one rail connector which includes a bolt and nut adapted to restrain a rail retainer element so that the rail retainer element secures the rail to the vehicle rail mounting device.

12. The vehicle rail mounting device of claim 1, including at least one rail connector which includes a T-bolt adapted to restrain a rail retainer element so that the rail retainer element secures the rail to the vehicle rail mounting device.

13. The vehicle rail mounting device of claim 1, wherein the bottom piece includes a bottom piece support portion and at least one restraint portion, the vehicle rail mounting device being adapted so that when in an operational orientation, the bottom piece support portion is adapted to support, above it, the at least one elastomeric element, and the at least one restraint portion extends upwardly relative to the bottom piece support portion, and includes, at or adjacent to an upper extremity thereof, said first bottom piece locking formations; and the or each top cover element includes a flange extending in a direction away from the top piece, the or each flange including said first top cover element locking formations.

14. The vehicle rail mounting device of claim 1, wherein at least one of the at least one elastomeric bearing element includes at least one slanted wall, wherein, when the vehicle rail mounting device is in an operational orientation, the or each slanted wall extends upwardly, and has a direction of slant relative to the vertical away from the top piece.

15. The vehicle rail mounting device of claim 14, including a space underneath the or each slanted wall, and a respective spacer located in the or each space, the or each spacer being adapted to support the or the respective slanted wall.

* * * * *